US007302808B1

(12) United States Patent
Teetzel et al.

(10) Patent No.: US 7,302,808 B1
(45) Date of Patent: Dec. 4, 2007

(54) COOLING MODULE AND CENTRAL SHAFT, HYDRATION MODULE AND IMPROVED GARMENT PENETRATOR THEREFOR

(75) Inventors: James W. Teetzel, York, ME (US); Gary M. Lemire, Lee, NH (US); Dominic R. Goupil, Kittery, ME (US); Marc J. Celona, Dover, NH (US)

(73) Assignee: Wilcox Industries Corp., Newington, NH (US)

( * ) Notice: Subject to any disclaimer, the term of this patent is extended or adjusted under 35 U.S.C. 154(b) by 294 days.

(21) Appl. No.: 11/242,975

(22) Filed: Oct. 4, 2005

(51) Int. Cl.
*F25D 23/12* (2006.01)

(52) U.S. Cl. ..... 62/259.3

(58) Field of Classification Search ..... 62/3.5, 62/259.3; 165/46; 2/171.3
See application file for complete search history.

(56) References Cited

U.S. PATENT DOCUMENTS

| | | | | |
|---|---|---|---|---|
| 2,255,751 | A | 9/1941 | Bancel | |
| 2,573,414 | A | 10/1951 | Dunn | |
| 3,496,703 | A | 2/1970 | MacLeod et al. | |
| 3,568,209 | A | 3/1971 | O'Neil et al. | |
| 3,630,039 | A | 12/1971 | Toshiyuki | |
| 3,916,911 | A | 11/1975 | Suader et al. | |
| 4,024,730 | A * | 5/1977 | Bell et al. | 62/259.3 |
| 4,146,933 | A | 4/1979 | Jenkins et al. | |
| 4,255,751 | A | 3/1981 | Goodman, Jr. | |
| 4,286,439 | A | 9/1981 | Pasternack | |
| 4,457,295 | A | 7/1984 | Roehr | |
| 4,459,822 | A | 7/1984 | Pasternack | |
| 4,513,452 | A | 4/1985 | Rankin, Sr. et al. | |
| 4,807,447 | A | 2/1989 | MacDonald et al. | |
| 4,914,752 | A | 4/1990 | Hinson et al. | |
| 4,998,415 | A | 3/1991 | Larsen | |
| 5,014,355 | A | 5/1991 | Vollenweider, II | |
| 5,062,424 | A | 11/1991 | Hooker | |
| 5,088,903 | A | 2/1992 | Tomatsu | |
| 5,197,294 | A | 3/1993 | Galvan et al. | |
| 5,214,926 | A | 6/1993 | Mandin et al. | |
| 5,255,390 | A | 10/1993 | Gross et al. | |
| 5,363,663 | A | 11/1994 | Chen | |
| 5,386,823 | A | 2/1995 | Chen | |
| 5,421,326 | A | 6/1995 | Rankin et al. | |
| 5,429,534 | A | 7/1995 | Cano | |
| 5,862,675 | A | 1/1999 | Scaringe et al. | |
| D408,093 | S | 4/1999 | Compton | |
| 6,209,144 | B1 | 4/2001 | Carter | |
| 6,802,370 | B1 | 10/2004 | Garigan et al. | |
| 6,808,372 | B2 | 10/2004 | Makino et al. | |
| 6,942,015 | B1 | 9/2005 | Jenkins | |
| 2002/0005196 | A1 | 1/2002 | Brugger | |
| 2002/0153126 | A1 | 10/2002 | Clemente | |

(Continued)

*Primary Examiner*—Melvin Jones
(74) *Attorney, Agent, or Firm*—McLane, Graf, Raulerson & Middleton, P.A.; Scott C. Rand

(57) ABSTRACT

In one aspect, the present disclosure relates to improved cooling module of a type for circulating water or other cooling fluid through a tube-lined cooling garment system. In another aspect, the present disclosure relates to a central shaft for the transmission of rotational power or torque. In yet another aspect, the present disclosure relates to a hydration system which may be employed in connection with the cooling module described herein. In still another aspect, the present disclosure relates to an improved garment pass-through connection system for penetrating one or more garment layers.

7 Claims, 9 Drawing Sheets

U.S. PATENT DOCUMENTS

2002/0158102 A1 10/2002 Patton et al.
2002/0177796 A1 11/2002 Suh
2002/0183665 A1 12/2002 Suh
2003/0150049 A1 8/2003 Szczesvil et al.
2004/0079517 A1 4/2004 Bueley et al.
2004/0159109 A1 8/2004 Harvie
2004/0210283 A1 10/2004 Rose et al.
2005/0172655 A1* 8/2005 Naaman ..... 62/259.3

* cited by examiner

COOLING MODULE AND CENTRAL SHAFT, HYDRATION MODULE AND IMPROVED GARMENT PENETRATOR THEREFOR

FIELD OF THE INVENTION

In one aspect, the present disclosure relates to improved cooling module of a type for circulating water or other cooling fluid through a tube-lined cooling garment system. In another aspect, the present disclosure relates to a central shaft for the transmission of rotational power or torque. In yet another aspect, the present disclosure relates to a hydration system which may be employed in connection with the cooling module described herein. In still another aspect, the present disclosure relates to an improved garment pass-through connection system for penetrating one or more garment layers.

BRIEF DESCRIPTION OF THE DRAWINGS

The invention may take form in various components and arrangements of components, and in various steps and arrangements of steps. The drawings, wherein like reference numerals refer to like or analogous components throughout the several views, are only for purposes of illustrating preferred embodiments and are not to be construed as limiting the invention.

DETAILED DESCRIPTION OF THE PREFERRED EMBODIMENTS

Figure 1:
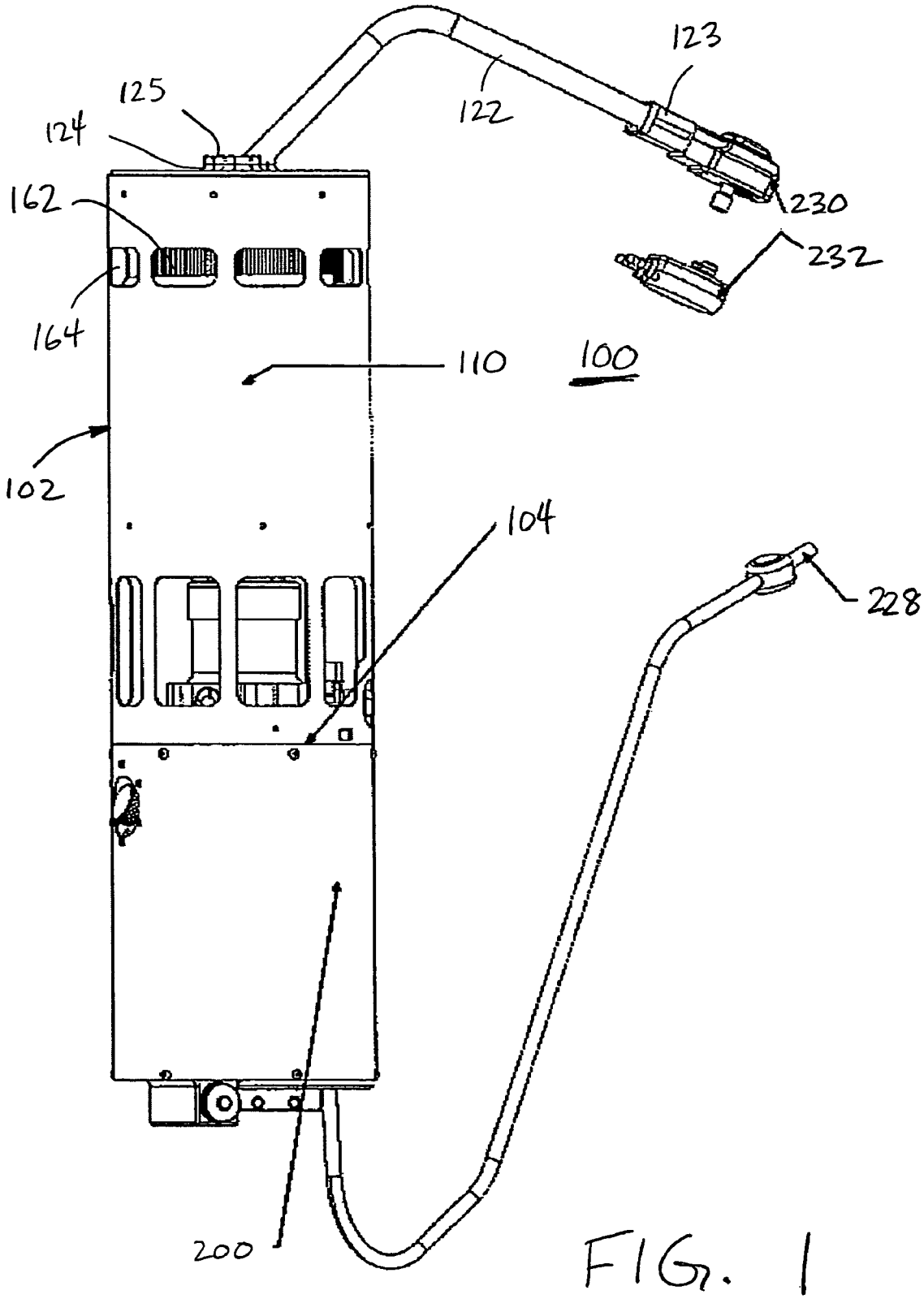
FIG. 1 is a side elevational view of a cooling module assembly according to an exemplary embodiment of the present invention.
Figure 3:
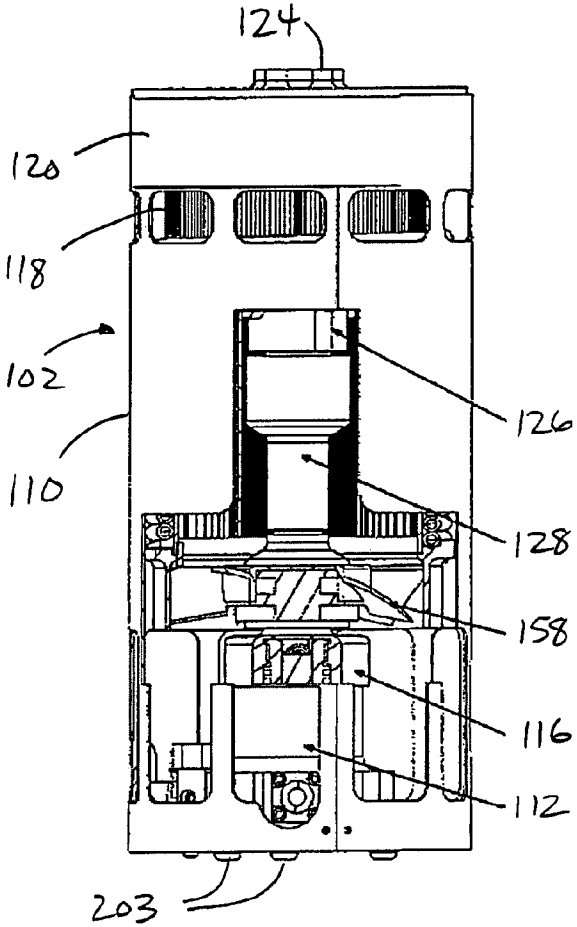
FIG. 3 is an elevational view of the cooling module component of FIG. 1, shown in partial cutaway.
Figure 2:
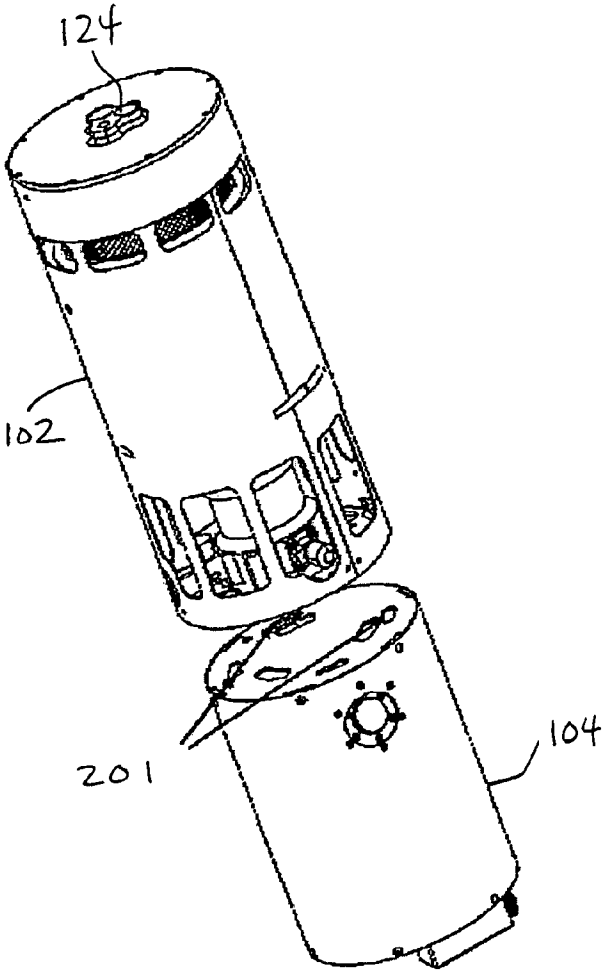
FIG. 2 is an exploded perspective view illustrating the manner of connecting the cooling module to the hydration system.

Referring now to FIGS. 1-3, there appears an exemplary embodiment of a cooling module assembly 100 including a vapor compression cooling device 102 for circulating a cooling fluid and an optional electrically operated hydration system 104 for delivering water or other potable liquid to a user under pressure.

In the preferred embodiment, the cooling module 100 is adapted to mount in the place of an air/breathing gas tank 108 of a breathing apparatus 106 such as a self-contained breathing apparatus (SCBA). In a particularly preferred embodiment, the cooling module 100 is adapted to replace a breathing cylinder of a combined SCBA and powered air-purifying respirator (PAPR) as disclosed in commonly assigned U.S. application Ser. No. 10/924,281 filed Aug. 23, 2004, the entire contents of which are incorporated herein by reference.

The cooling device 102 includes a housing 110 encasing a motor 112. The motor 112 is driven by a power supply, which may be a battery, battery pack, or the like, preferably a rechargeable battery or battery pack. The unit may be electrically coupled to an external power source for operation and/or charging of an internal power supply, such as the power supply of the breathing apparatus 106, a vehicle power supply, AC mains, or the like.

The motor 112 drives a compressor 116 which is fluidically coupled to a condenser 118 and an evaporator 120. The compressor 116, condenser 118, and evaporator 120 define a refrigeration loop, through which a refrigerant is circulated, to provide cooling to water or other cooling fluid circulated through a cooling garment to be worn by the user. Exemplary refrigerants include, but are not limited to chlorocarbons (e.g., ethyl or methyl chloride), chlorofluorocarbons (e.g., Freon, Ucon, Genetron, or the like), ammonia, sulfur dioxide, or other known refrigerants.

The water or other cooling fluid circulated through the cooling garment is delivered through conduits 122, which attach to the cooling unit 102 via a connection 124, which may be a quick connect/disconnect coupler. Cooled fluid is passed through a tube-lined cooling suit, thereby absorbing heat from the user's body and providing a cooling effect. The warmed cooling fluid is returned to the cooling unit 102 wherein it passes in heat exchange relation to the evaporator 120, thereby cooling the cooling fluid. The cooled fluid is then returned to the cooling garment, and so forth.

The water or other cooling fluid is circulated via a pump 126, which has an inlet and outlet fluidically coupled to a respective outlet and inlet of the conduits 122. The pump 126, in turn, receives rotational power or torque from the motor 112 via a central shaft assembly 128, as described in detail below.

Figure 7:
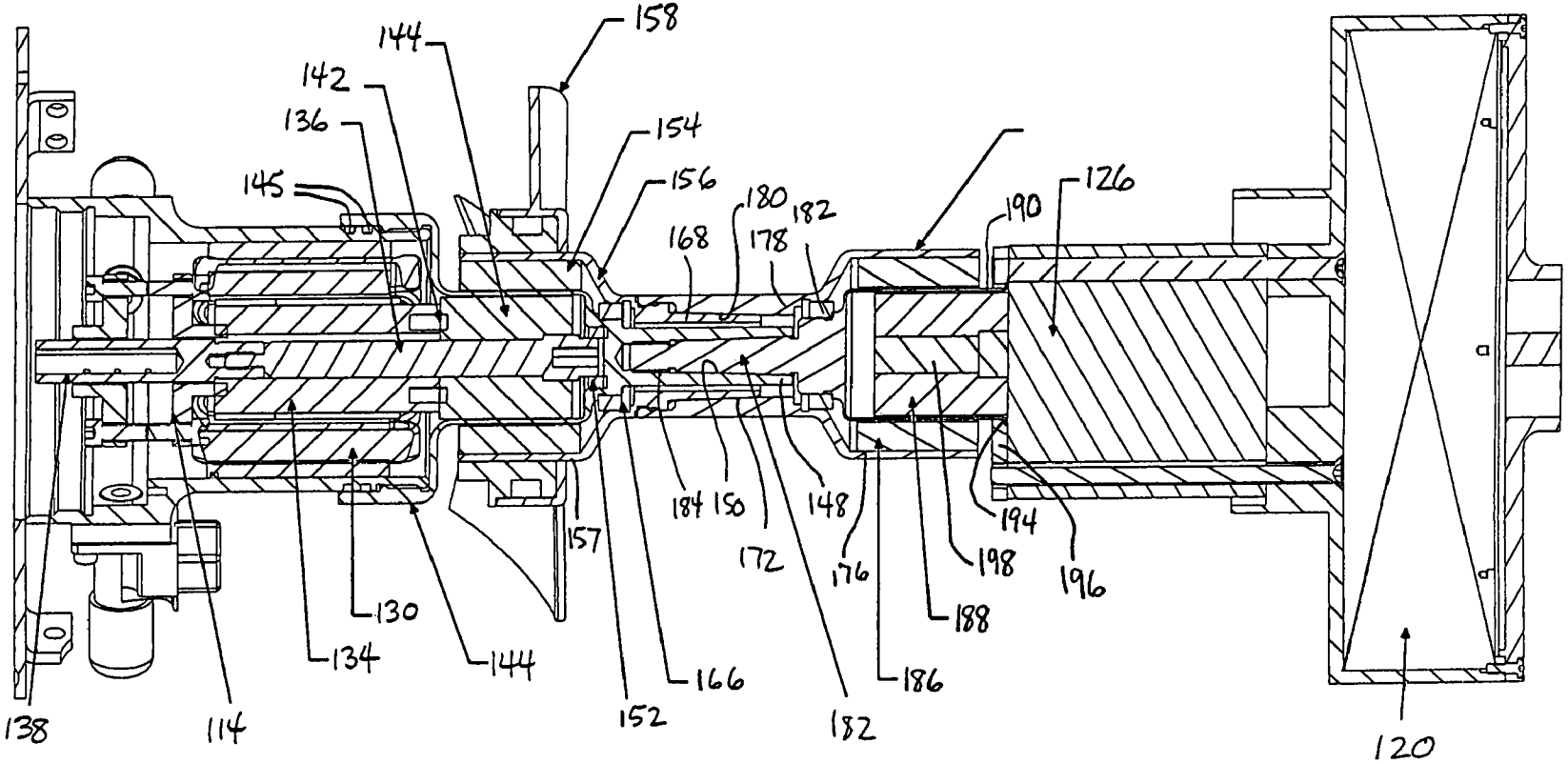
FIG. 7 is cross-sectional view of the cooling module component of FIG. 5, illustrating the rotational transmission components thereof.

As best seen in FIG. 7, the motor 112 includes a stator 130 supported within a housing 132. The compressor 116 is secured to the housing 132. The motor 112 electrodynamically drives a rotor 134 and drive shaft 136. The shaft 136 is coupled at a first end to a drive shaft 138 of the compressor 116. The shaft 136 is coupled at the opposite end to an internally sealed drive magnet 140. One or more anti-rotation pins or dowels 142 secure the drive magnet 140 to the rotor 134.

The drive magnet 140 is contained within a non-rotating housing cap 144, which is formed of a non-magnetically attractable material, such as stainless steel, aluminum, polymer material, or the like. A first end 146 of the housing cap 144 includes an opening or cavity which is secured about the motor housing 132. A second end 148 of the housing cap 144 opposite the first end 146 defines a tapered, threaded opening 150. An internal bearing 152 rotatably supports the end of the drive shaft 136. One or more sealing rings 145 may be provided to prevent entry of moisture or other environmental contamination into the motor 112 and compressor 116.

An external, driven magnet 154 is coaxially received about the housing cap 144 in axial alignment with the drive magnet 140. The driven magnet 154 is magnetically coupled to the drive magnet 140 and rotates therewith. The driven magnet 154 is contained within an enlarged bell end 157 of a magnet housing 156. A fan 158 is carried on the magnet housing 156 and rotates with the magnet 154 and magnet housing 156.

In operation, the fan 158 rotates to draw ambient air in through a set of top openings 164 formed in the housing 110 and force it over condenser coil fins 162 and out through a set of lower openings 160. In operation, the refrigerant gas is liquefied by the increased pressure of the gas created by the compressor 116. The heat of condensation given up by the refrigerant in its conversion into liquid form is removed by the fan 158. The liquid refrigerant from the condenser 118 is delivered the evaporator section 120, e.g., through a pressure restricting device (not shown) for refrigerant vaporization. The cooling fluid carrying heat absorbed from the user is delivered to the evaporator, e.g., via a heat exchanger (not shown), resulting in an increase in temperature of the refrigerant sufficient to cause it to vaporize, thereby cooling the cooling fluid prior to recirculation through the cooling garment.

The magnet housing 156 is, in turn, rotatably supported on an external bearing 166 carried on the exterior of the housing cap 144. The magnet housing 156 includes an axially extending member 168 comprising an internal axial bore 170 and a tapered exterior surface 172. The internally tapered member 148 of the housing cap 144 is coaxially received within the axial bore 170 of the axially extending member 168.

The rotating magnet housing 156 is rigidly coupled to a second magnet housing 174 having an enlarged bell end 176 and an axially extending member 178. The axially extending portion 178 includes a tapered and threaded internal surface 180 which is complimentary with the external tapered surface 172 of the first magnet housing 156 to provide a rigid coupling therebetween.

The second magnet housing 174 is rotatably supported on a second external bearing 183 which, in turn, is supported on a fixed shaft member 183. The fixed shaft member includes a tapered and threaded exterior surface 184 which is complimentary and mating with the interior surface of the opening 150 to provide a rigid interconnection therebetween.

The bell end 176 of the second magnet housing receives an external water pump drive magnet 186, which is secured therein rotated by the rotation of the magnet 154 and the rigid coupling between the first and second magnet housings 156 and 174, respectively. The external drive magnet 186 drives an internal water pump magnet 188. The internal water pump magnet is sealed within a magnet housing 190 defining an enlarged opening receiving the magnet 188. In the depicted embodiment, a flange 194 formed on the magnet housing 190 is secured to the water pump 126 via a flange clamp 196 and threaded fasteners or other mechanical fasteners. The internal magnet 188 is rigidly secured to an axial shaft 198 which rotates with the magnet 188 to drive the water or other cooling fluid circulation pump 126.

The rotating housings 156 and 174 may be formed of aluminum, stainless steel, plastic, or the like, and may be formed of the same material as the rotationally immobilized housing members 144 and 182. The magnets 154 and 186 may be rigidly secured within the sleeve portions of the housing members 156 and 174, respectively, via a number of methods, including, mechanical fasteners, or more preferably, an adhesive.

Figure 4:
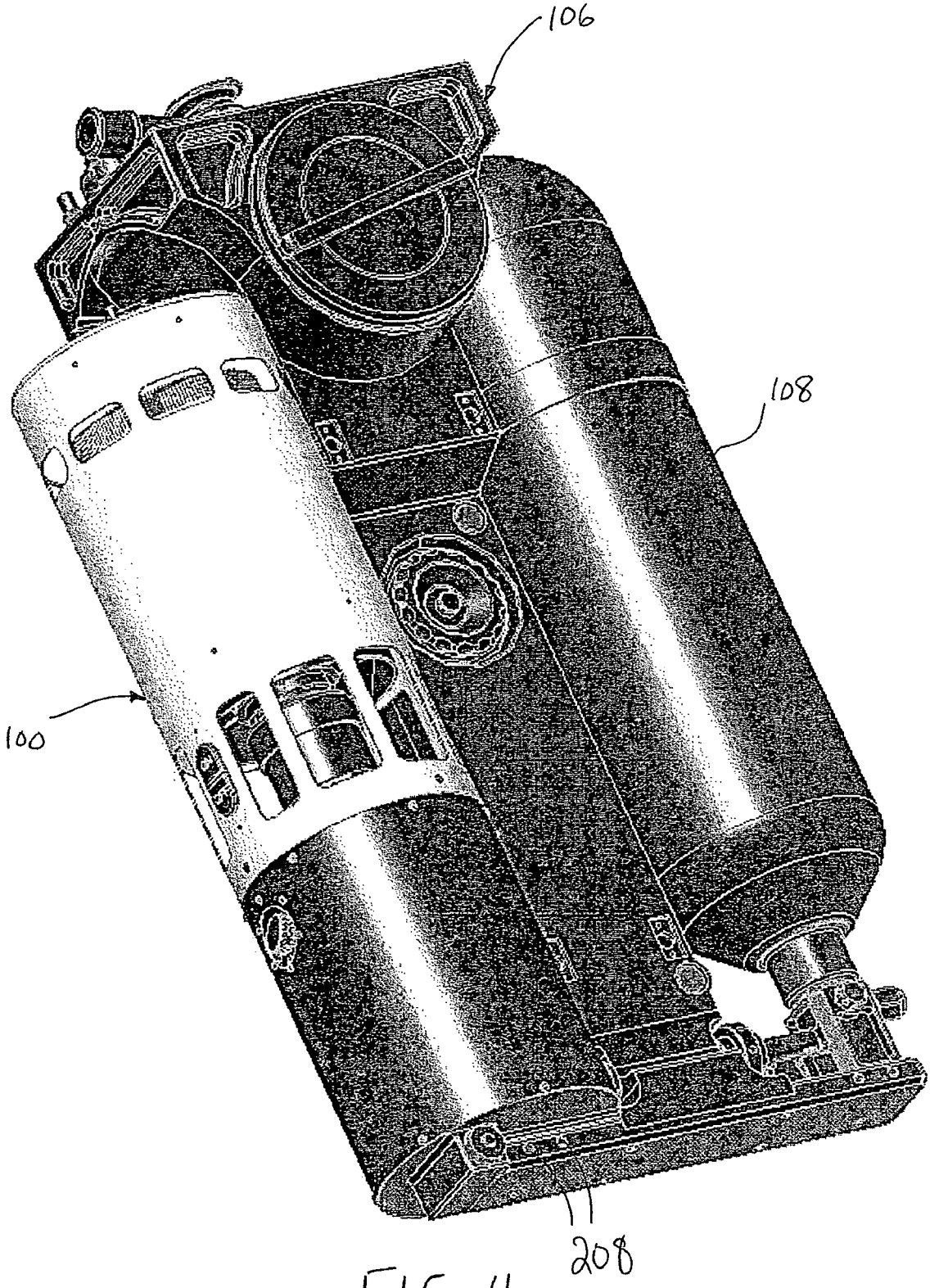
FIG. 4 illustrates the cooling module of FIG. 1 mounted in place of an air tank in a breathing apparatus.
Figures 5, 6:
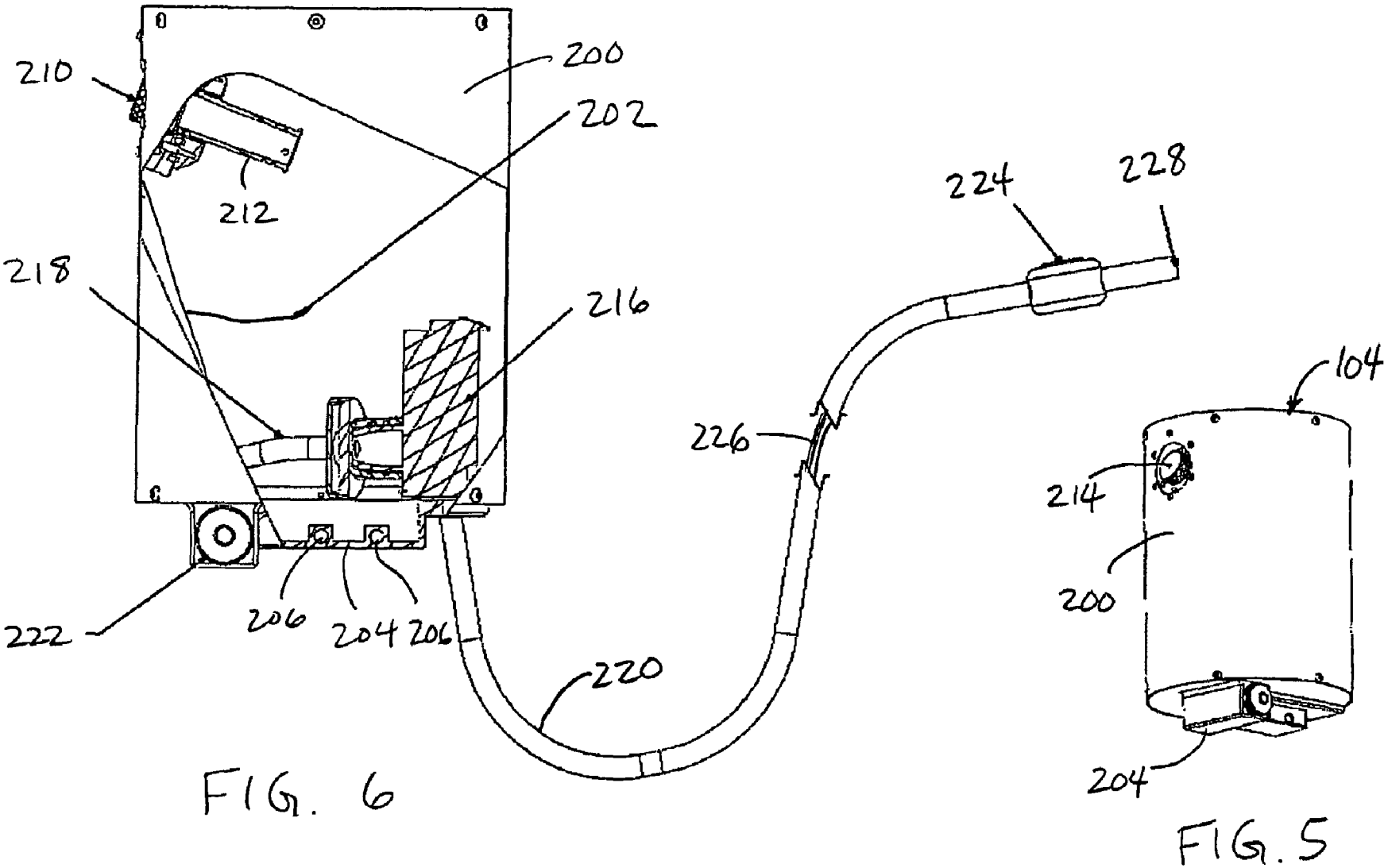
FIG. 5 is a perspective view of the hydration module according to an exemplary embodiment, illustrating the power source and mounting foot for the cooling module assembly.
FIG. 6 is a side elevational view of the hydration module of FIG. 3, shown in partial cutaway.

With reference now to FIGS. 5 and 6, the hydration unit 104 includes an external housing 200 lined with a chemically hardened bladder 202. In the depicted preferred embodiment wherein the unit 100 approximates the size and shape of an air cylinder for connection to a breathing apparatus, the base of the housing 200 includes a connection shoe 204 for receiving within a complimentary connector located on the breathing apparatus 106. Openings 206 on the connection shoe 204 align with openings in the breathing unit 106 for receiving retaining pins 208 (see FIG. 4) to prevent inadvertent ejection of the cooling unit 100. Connection to other types of harnesses, packs, or garments is also contemplated.

A fill port 210 is provided to fill the internal bladder 202 with water or other potable liquid. In the depicted embodiment, the fill port 210 includes an extendable tube 212 which is stored within the interior of the hydration unit 212 when the fill port is closed, e.g., via a threaded cover or cap 214, and which can be slidingly extended therefrom to assist in filling the container.

A water pump 216 may be provided within the interior compartment to deliver water/fluid to the user under pressure. The pump includes a pickup tube 218 attached to an inlet of the pump 216 and a conduit 220 coupled to an outlet of the pump 216. A power supply 222, such as a battery or battery pack, may be provided to supply electrical power to the pump 216. Alternatively, the pump may be electrically coupled to a power supply of a powered breathing system or other external power source.

In the depicted preferred embodiment, a water pump activation switch 224 is connected to the conduit 220, preferably within easy reach of the operator. The switch 224 is electrically coupled to the pump 216 via electrical conductors 226, e.g., passing within the conduit 220. The conduit 220 includes a drink tube 228 of a type adapted for connection to a standard drink tube fitting on a breathing mask.

With reference now to FIGS. 2 and 3, the cooling module 102 is connected to the hydration module 104 in the depicted preferred embodiment via a bayonet type mounting system. A plurality of keyhole shaped openings 201 on the hydration module 102 are aligned with a plurality of protrusions 203 on the cooling module. The protrusions 203 are inserted into the openings 201 and the cooling module is rotated relative to the hydration module. Other fastening members or locking devices are also contemplated to prevent the cooling module from becoming disengaged from the hydration unit. It will be recognized that the hydration unit is an optional component. In certain embodiments, the hydration unit may be replaced with a blank member which occupies the same amount of space occupied by the hydration unit and provide a connection foot for securing the unit in place of a breathing gas tank on a breathing apparatus. In other embodiments, the hydration unit may be omitted and the connection foot may be provided directly on the cooling module 102.

Figure 8:
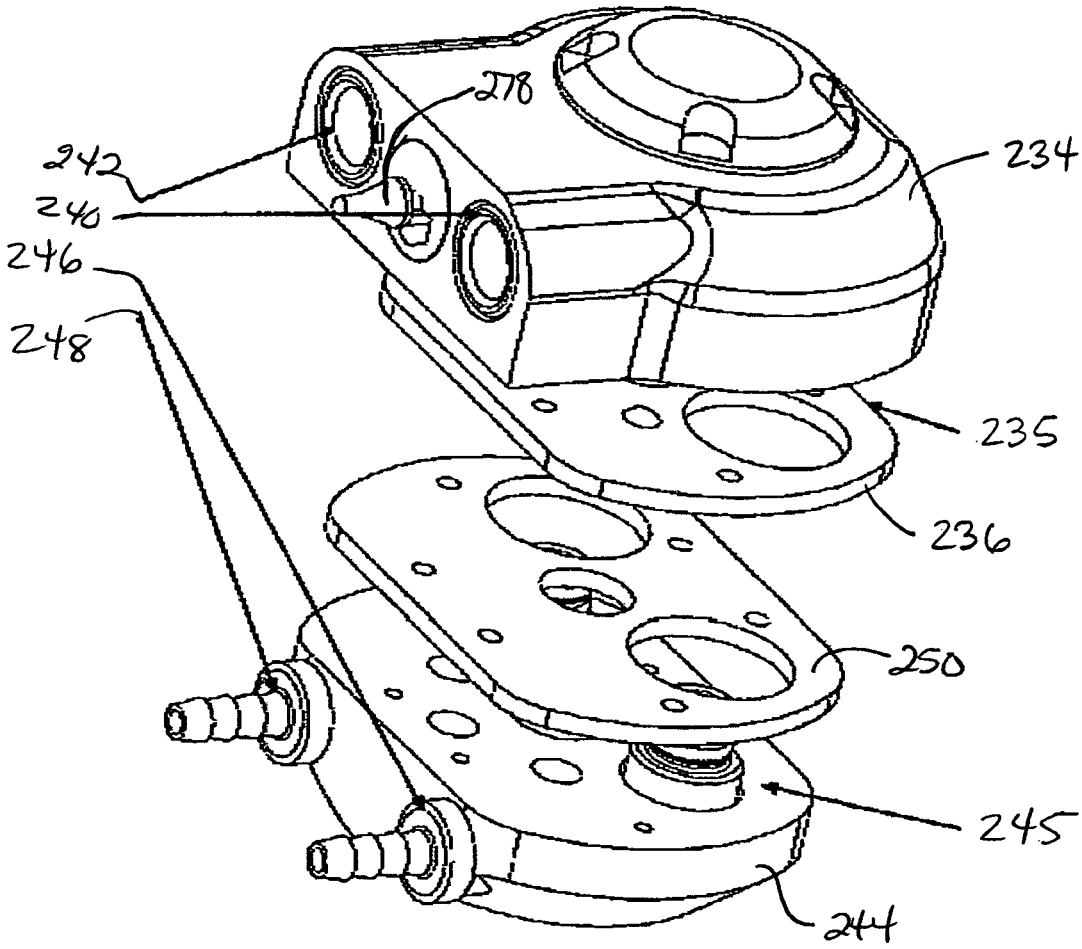
FIG. 8 is an exploded perspective view illustrating a garment penetration system according to an exemplary embodiment.

With reference now to FIG. 8, a penetrator system appears for use with a garment system of a type including an outer protective garment and an inner cooling garment, which is worn under the outer garment. The outer protective garment may be, for example, a heat resistant garment, chemical resistant garment, or a garment otherwise providing a barrier to external contaminants, such as chemical agents or other hazardous materials, extreme environmental conditions, and so forth. Such garments and materials that may be used therefore are generally known to those skilled in the art. The outer garment may be, for example, a coat, parka, one-piece coverall, or the like. Likewise, the depicted embodiment is adapted for a system employing two garment layers. It will be recognized that the penetrator system herein may be readily adapted to garment systems having three or more garment layers by employing additional connector units as necessary.

The inner cooling garment is of a type having tubing therein carrying a cooling fluid circulated by the cooling fluid pump 126. As is generally understood in the art, the tubing carrying the fluid is in close body contact (typically on or in an interior surface of the garment) with the wearer so as to effect the transfer of heat from the wearer.

The penetrator system includes an outer connector 230 which provides a flow connection between the cooling fluid conduit 122 with connector 123 and an inner connector assembly 232. The inner and outer connector assemblies 230 and 232 are positioned on the inner and outer garments so as to come into a generally aligned relationship when both suits are worn as a layered set by the user. In the depicted preferred embodiment, the fluid passageways in the connectors 230 and 232 form right angles, thereby defining a low profile as compared to linear connectors.

The outer connector assembly 230 includes an outer block connector 234 which is intended to be located on an exterior surface of the outer protective garment. An outer garment retaining plate 236 is located on an interior surface of the outer garment and is secured to the inward facing surface of the outer block connector 234, e.g., via one or more fasteners 238, thereby clamping the outer garment (not shown) therebetween. The garment may be reinforced with additional layers of fabric or other reinforcing material at the location of the connector assembly 230.

The outer block connector 234 includes a fluid inlet valve 240 and a fluid outlet valve 242 for connection to the cooling unit 102, e.g., via a mating connector 123 attached to the conduits 122. The conduits 122 terminate at the opposite end at connector 124 on the unit 102. The outer block connector 234 and retaining plate 236 may be positioned at any desired location on the garment, and is preferably within easy reach of the wearer. In one embodiment, e.g., for military use, the outer block connector 236 may be positioned on or near the shoulder opposite the user's shooting shoulder, and the invention may be adapted for left or right handed marksmen. Placement of the connector 236 toward the rear of the shoulder is particularly advantageous for use with the breathing apparatus 106 or other portable cooling units of a type adapted to be worn on the user's back. Other positions of the fluid connectors relative to the body of the wearer are also contemplated.

The inner block assembly 232 includes an inner block connector 244 having a fluid inlet 246 and outlet 248, which may be barbed hose connectors, e.g., for connection to the tubing of a tube lined suit worn beneath a protective outer garment as described above. The inner block connector 244 may be secured about an opening in the cooling suit at a position so that it is generally aligned with the position of the outer block connector 234 when the inner and outer garments are donned by the user. An inner retaining plate 250 is located on an exterior facing surface of the cooling suit and is secured to the inner block connector 244 in clamping fashion, e.g., with one or more threaded connectors 253. The cooling garment may be reinforced with additional layers of fabric or other reinforcing material at the location of the connector assembly 232. A chemical or other protective outer garment layer 235 is disposed between the outer block 234 and the plate 236. A cooling garment layer 245 is disposed between the inner block 244 and the plate 250.

Figure 9:
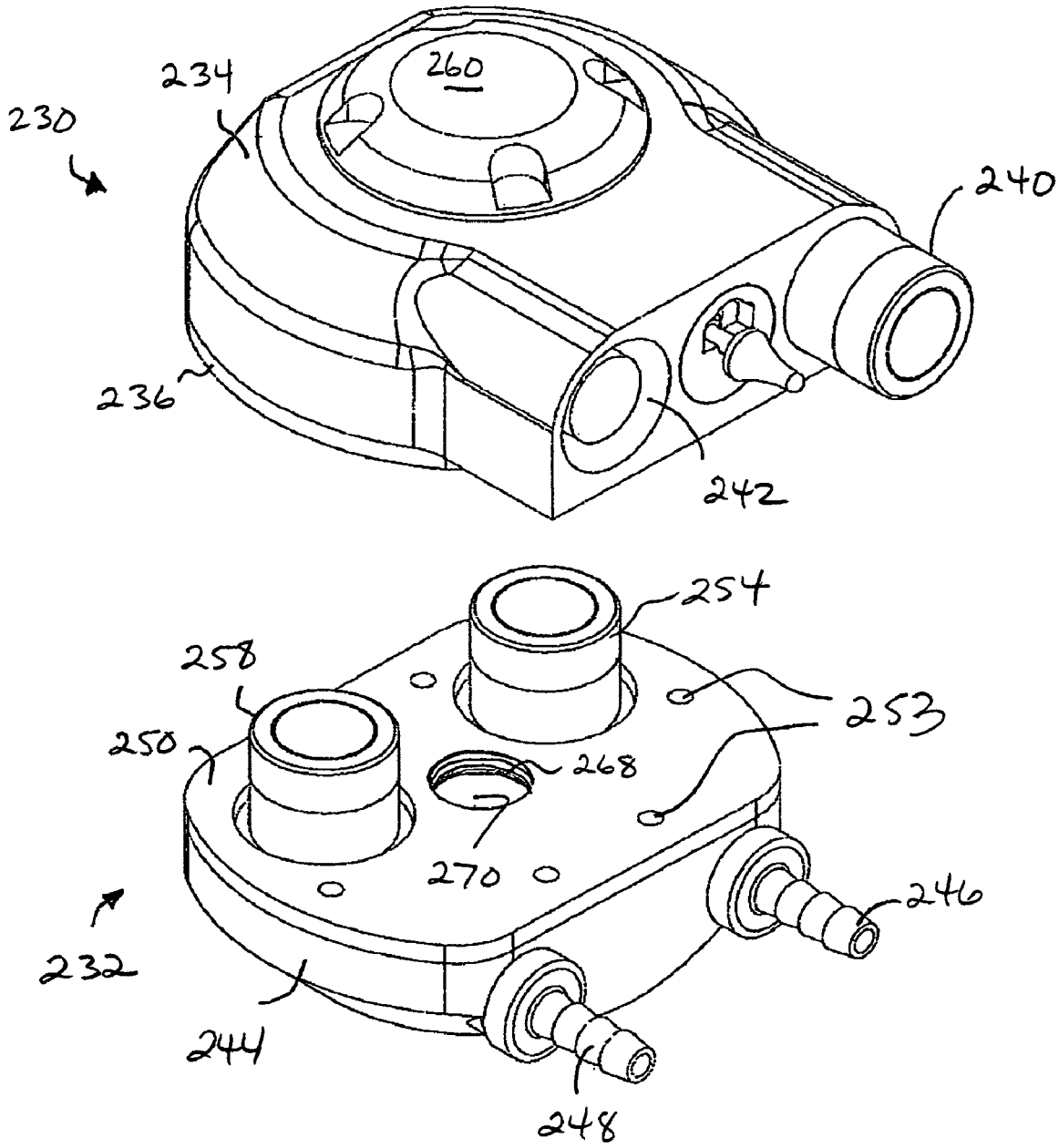
FIGS. 9 and 10 are exploded perspective views illustrating a garment penetration system according to an alternative exemplary embodiment.
Figure 10:
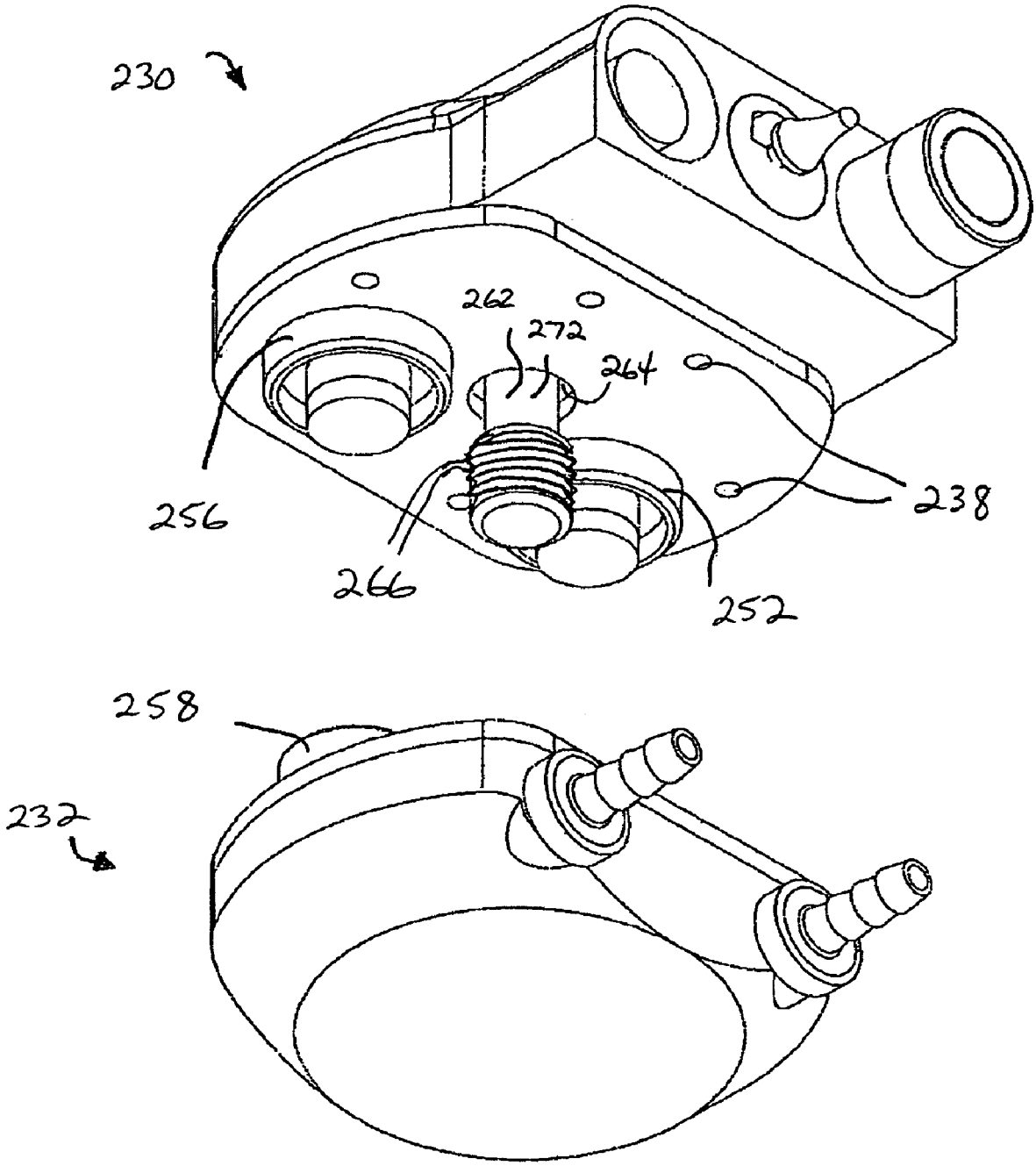

FIGS. 9 and 10 illustrate an alternative embodiment substantially as shown in FIG. 8, but wherein the connector block 234 includes male and female dripless connectors 240 and 242 so as to ensure proper orientation when connected. Other manners of ensuring consistent orientation include providing a keyed connection, e.g., via the shape or features on the connector housings, markings on the connectors, or the like. The outer block connector 234 includes a dripless outlet valve subassembly 252 which cooperates with an inlet valve subassembly 254 on the inner block connector 244. Likewise, a dripless outlet valve subassembly 256 on the outer block connector 234 cooperates with a dripless inlet valve subassembly 258 on the inner block connector 244. By dripless valve is meant self-sealing connectors including a valve movable between an open position when the connectors are in a coupled state and which are self sealing to obstruct flow when the connectors are in an uncoupled or disconnected state. The dripless connectors may be a valve coupling as shown in U.S. Pat. No. 6,302,147, which is incorporated herein by reference in its entirety. However, other fluid connection types, including but not limited to quick connect/disconnect systems and dripless or self-sealing systems as generally known in the art pertaining to the connection of fluid-carrying hoses or tubing, are also contemplated.

A threaded fastener 260 is provided on the outer block connector 234 and includes a rod 262 passing through an opening 264 in the block connector 234. The rod 262 includes helical threads 266 which are complementary with internal helical threads 268 formed in an opening 270 in the inner block connector 244. Optionally, in a preferred embodiment, the rod 262 additionally includes an unthreaded portion 272 and a portion of the connector block 234 contains internal threads so that the threaded end 266 of the threaded fastener 260 must be threaded through an opening in the outer block portion 234 prior to being threaded into the opening 270, thereby capturing the threaded fastener 260 and preventing inadvertent removal of the threaded fastener 260 from the outer block connector 234 when disconnected from the inner connector 244.

Figure 11:
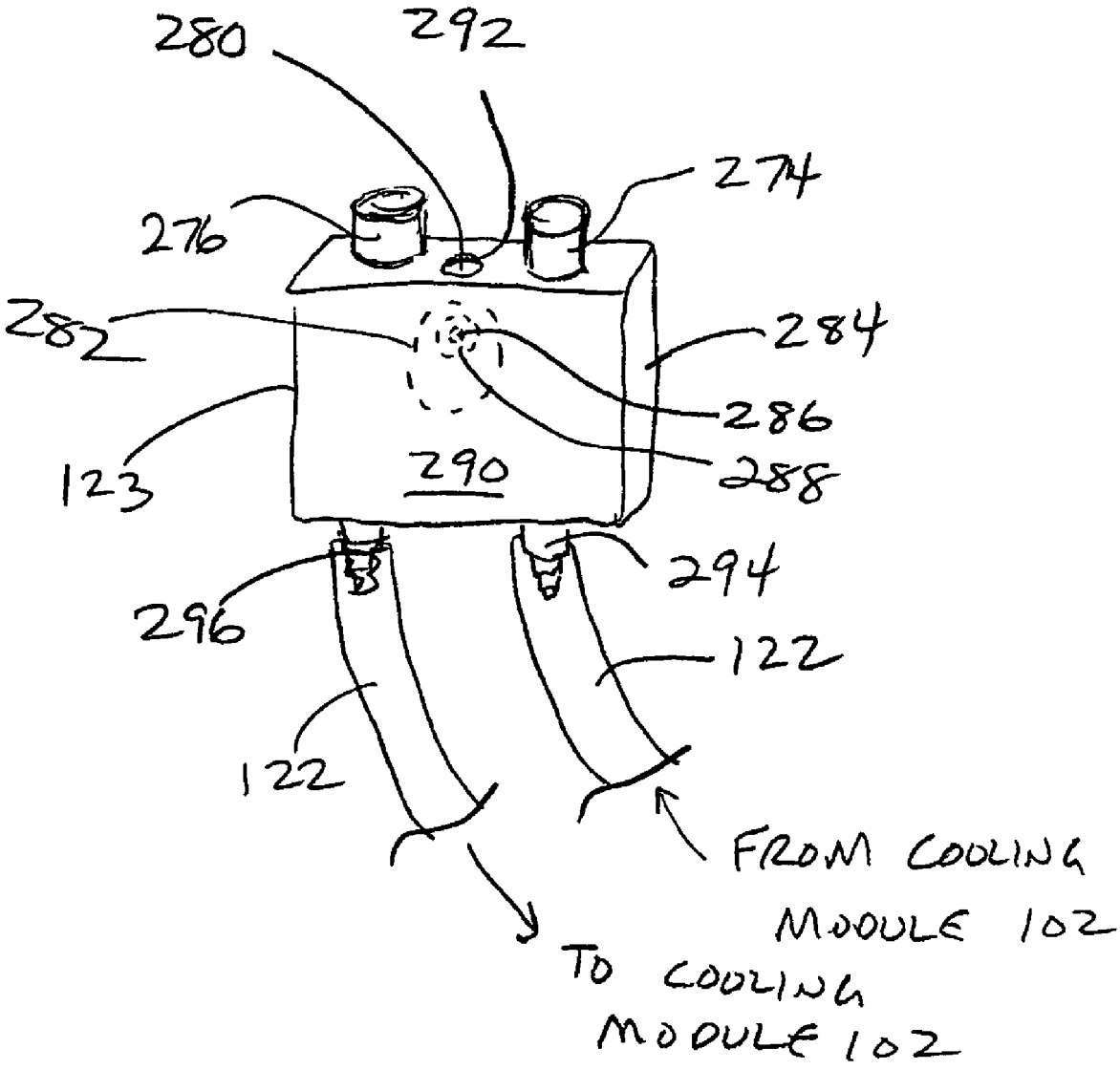
FIG. 11 illustrates an exemplary connection between the outer connector and a connector of the cooling module.

Referring now to FIG. 11, and with continued reference to FIG. 8, there is illustrated an exemplary connector 123 of the cooling module 102 which is adapted for connection with the outer connector 230. The inlet valve 240 of the outer connector 230 connects with an outlet valve 274 of the cooling module connector 123. Likewise, the outlet valve 242 of the outer connector 230 connects with the inlet valve 276 of the cooling module connector 123. It will be recognized that other arrangements of male and female connectors may also be employed. It will be recognized that the designations of inlet and outlet valves described herein are exemplary only and are preferably selected to provide the most efficient cooling of the wearer. For example, body heat tends to be greatest toward the geometric center of the body to be cooled. Thus, it is generally desirable for the cooling fluid to pass over more central regions, such as the spine area, prior to passing over more peripheral areas. In preferred embodiments, the connectors are configured to fit only in the orientation that provides the desired flow direction, e.g., by providing adjacent male and female connectors (see FIGS. 9 and 10), by keying the connectors, by providing markings or indicia of flow direction, and so forth.

In the depicted preferred embodiment, a quick release mechanism includes a latch member 278 having a tapered end which protrudes from the connector block 234 housing and which, in operation, extends into an aligned opening 280 on the connector 123 to provide a latching connection therewith. Once connected, the connectors 230 and 123 may be disconnected via a number of methods. In one method, an optional release button 282 may be provided. For example, a depressible button 282 may be provided on the housing shell 284 of the connector 123 wherein an internal pin 286 or other mechanical coupling or engagement between the button and the tapered latch member 278 may be provided for moving the latch from a latched position to an unlatched position when the button 282 is depressed by a user. A spring member 288 may also be provided to bias the button 282 toward the undepressed position. In an especially preferred embodiment, the button 282 is positioned on an inward facing surface of the connector 123 housing, which is opposite an outward facing surface 290 thereof. Such placement provides easy manipulation of the button 282 with a user's thumb when the connector unit is located at the user's shoulder region as described above. However, button placement elsewhere on the unit is also contemplated.

In certain embodiments, a lip 292 of the opening 280 and the latching surface of the latch member 278 are configured to disconnect upon the application of some predetermined or preselected degree of force, without the need to depress the release button 282 (if so provided). This would allow the user to readily shed the cooling module, e.g., under emergency conditions, without the need to first locate and manipulate the release button or other mechanism. The inlet and outlet 294 and 296, respectively, of the connector 123 may be barbed hose connectors for connection to the conduits 122.

The invention has been described with reference to the preferred embodiment. Modifications and alterations will occur to others upon a reading and understanding of the preceding detailed description. It is intended that the invention be construed as including these and other modifications and alterations.

Having thus described the preferred embodiments, the invention is now claimed to be:

1. A central shaft assembly for transmitting rotational power, comprising:

a drive assembly including a rotor and a first rotating shaft having an axis of rotation;

a first rotating magnet rigidly mounted coaxially about said rotating shaft;

a first stationary housing sealing said first rotating magnet from environmental contamination, said rotating shaft rotatably supported within said first stationary housing;

a second rotating magnet rotatably supported on said housing about said axis of rotation in axial alignment with said first rotating magnet;

a first rotating housing including a coaxial sleeve portion receiving the second rotating magnet and coupled thereto and an axially extending member defining an axial bore, said first rotating housing rotatably supported on said first stationary housing;

a second rotating housing including a second coaxial sleeve portion and a second axially extending member, said first and second axially extending portions axially overlapping and interlocking;

a third rotating magnet received within said second coaxial sleeve portion;

a fourth rotating magnet;

a second stationary housing receiving said fourth rotating magnet and sealing said fourth rotating magnet from environmental contamination;

said third rotating magnet and said second rotating housing rotatably supported on said second stationary housing about said axis of rotation, said third rotating magnet in axial alignment with said fourth rotating magnet;

said first stationary housing including an third axially extending member and said second stationary housing including a fourth axially extending member, said third and fourth axially extending members overlapping and interlocking within said axial bore; and a second rotating shaft coupled to and rotating with said fourth rotating magnet.

2. The central shaft assembly of claim 1, further comprising a third rotating shaft coupled to said first rotating shaft.

3. A cooling apparatus of a type for circulating a cooling fluid through a cooling garment for removing heat from the body of a user donning the cooling garment, comprising:

a refrigeration unit including a compressor, a condenser, and an evaporator;

a motor driving a first rotating shaft for delivering rotational power to said compressor;

a pump for circulating the cooling fluid;

a heat exchanger in fluid communication with said pump for transferring heat absorbed by the cooling fluid to a refrigerant in said refrigeration unit;

a second rotating shaft for delivering rotational power to said pump; and a sealed magnetic drive coupling between the first rotating shaft and the second rotating shaft.

4. The cooling module of claim 3, further comprising an elongate housing, said module adapted to mount to a breathing apparatus in place of a breathing gas tank.

5. The cooling module of claim 3, further comprising a hydration system delivering a potable fluid to a user.

6. The cooling module of claim 5, wherein said hydration system includes a pump for delivering a potable fluid to a user under pressure.

7. A garment pass-through connection system for coupling an external cooling unit through a plurality of garment layers to a cooling garment fluid channel for circulating a cooling fluid, comprising:

a first fluid connector for fluid connection to the external cooling unit;

said first fluid connector disposed on an exterior surface of an outer protective garment;

a first retaining plate disposed on an interior surface of the outer protective garment and secured to the first fluid connector;

a second fluid connector for fluid connection to the cooling garment fluid channel;

said second fluid connector disposed on an interior surface of the cooling garment;

a second retaining plate disposed on an exterior facing surface of the cooling garment and secured to the second fluid connector;

the first and second fluid connectors adapted to be releasably connected to define a flow passageway between the external cooling unit and the cooling garment fluid channel.

* * * * *